United States Patent [19]

Burandt

[11] 4,414,931

[45] Nov. 15, 1983

[54] VARIABLE VALVE OPERATING MECHANISM FOR INTERNAL COMBUSTION ENGINES

[75] Inventor: Corliss O. Burandt, Plymouth, Minn.

[73] Assignee: Investment Rarities, Incorporated, Minneapolis, Minn.

[21] Appl. No.: 310,655

[22] Filed: Oct. 13, 1981

[51] Int. Cl.[3] ..... F01L 1/18

[52] U.S. Cl. ..... 123/90.16; 123/90.44

[58] Field of Search ..... 123/90.15, 90.16, 90.17, 123/90.27, 90.39, 90.44

[56] References Cited

U.S. PATENT DOCUMENTS

| | | | |
|---|---|---|---|
| 3,413,965 | 12/1968 | Gavasso | 123/90.16 |
| 3,722,484 | 3/1973 | Gordini | 123/90.39 |
| 3,897,760 | 8/1975 | Hisserich | 123/90.18 |

FOREIGN PATENT DOCUMENTS

| | | | |
|---|---|---|---|
| 611328 | 9/1926 | France | 123/90.44 |
| 55-151106 | 11/1980 | Japan | 123/90.16 |
| 1527743 | 10/1978 | United Kingdom | 123/90.15 |

*Primary Examiner*—Craig R. Feinberg
*Assistant Examiner*—W. R. Wolfe
*Attorney, Agent, or Firm*—Peterson, Palmatier, Sturm, Sjoquist & Baker, Ltd.

[57] ABSTRACT

The variable valve operating mechanism comprises lower and upper rocker arms, each having a straight section and a curved cam section. The lower rocker arm is mounted for pivotal movement about a fixed axis and the upper rocker arm is mounted for pivotal movement about a shiftable axis. The free end of the lower rocker arm engages the valve to be actuated and the free end of the upper rocker arm engages the straight section of the first rocker arm when the shiftable axis is spaced relatively far from the fixed axis. When the shiftable axis is moved toward the fixed axis, the valve lift starts to increase. Continued movement, however, causes the engine's cam to engage the curved cam section of the upper rocker arm to lengthen the duration or time that the valve is open. In this way, valve lift and the duration of time that the valve remains open can be controlled in accordance with certain engine operating conditions. Provision is made for lubricating parts of the mechanism and provision is also made for adjusting certain parts of the mechanism so as to provide a specified amount of valve lash.

25 Claims, 4 Drawing Figures

VARIABLE VALVE OPERATING MECHANISM FOR INTERNAL COMBUSTION ENGINES

CROSS-REFERENCE TO RELATED APPLICATIONS

My copending application titled "Apparatus and Method for Controlling the Valve Operation of an Internal Combustion Engine", Ser. No. 310,510 filed on Oct. 13, 1981, and my copending application titled "Apparatus and Timing Mechanism for Controlling the Valve Operation of an Internal Combustion Engine", Ser. No. 310,637, filed on Oct. 13, 1981 both contain subject matter related to this application.

BACKGROUND OF THE INVENTION

1. Field of the Invention

This invention relates generally to internal combustion engines, and pertains more particularly to a valve operating mechanism therefor.

2. Description of the Prior Art

A relatively large number of mechanisms have been devised for controlling the opening and closing of inlet and exhaust valves for internal combustion engines. Those known to me have had various shortcomings. In this regard, some are quite simple, but perform only one function, such as controlling the height of valve opening, frequently referred to as the valve lift. Others have controlled the period or duration of valve opening without varying the lift.

One relatively early patent which depicts a mechanism for adjusting only the valve lift is U.S. Pat. No. 1,395,851, issued Nov. 1, 1921, to Francis B. McLean for "Valve Operating Mechanism". The effective moment arm or leverage for effecting the opening of the valve is derived from a rocker arm that is pivotally mounted intermediate its ends, the fulcrum or pivot point being shiftable in order to vary the amount of valve lift produced by the valve cam.

A patent depicting a mechanism that determines both the amount of valve lift and the time that the valve remains open is found in U.S. Pat. No. 2,412,457, issued on Dec. 10, 1946 to Laurence D. Harrison for "Valve Actuating Mechanism". The mechanism employs a profiled or contoured adjusting lever or rocker arm that is shifted relative to the valve to be opened and closed. However, the control of the lift and duration are integrated with each other and one cannot be realized in practice without affecting the other. Here again, the predominant change is in the duration, the correlated change in lift being quite minimal.

For the most part, prior art devices for varying the valve lift are indeed quite complicated and relatively costly. Furthermore, some of the devices with which I am acquainted contain parts that are vulnerable to wear with the consequence that their lift span is unduly short. In such instances, the owner would be confronted with the likelihood of frequent and costly repairs, thereby militating against the adoption of such valve actuating mechanisms.

SUMMARY OF THE INVENTION

Accordingly, one object of my invention is to provide a valve operating mechanism that will progressively cause a desired change in valve lift followed by a desired change in the duration that the valve is open.

Another object of the invention is to provide a valve operating mechanism of the foregoing character in which the lift can be increased to a practical maximum before the duration is increased.

Inasmuch as the internal combustion engine of a vehicle functions most of the time under cruise conditions, the engine in such instances requiring only an increase in power for acceleration or at other abnormal loads, an object of my invention is to provide a valve operating mechanism that will reliably change from a fuel efficient (thermally efficient) cruise or normal operating condition to a mechanically efficient (volumetrically efficient) operating condition, doing so very rapidly.

It is also an object of my invention to provide a variable valve operating mechanism that will be of simple construction and which can be manufactured for a relatively low cost, particularly when measured with respect to the fuel savings to be realized.

Yet another object of the invention is to provide a variable valve operating mechanism that will adhere to present-day emission standards, emission problems becoming negligible where the performance mode is changed for only short periods, such as those experienced during fast acceleration or under extreme load conditions. Stated somewhat differently, deviations from accepted emission standards may be tolerated for short periods of time, whereas they cannot for prolonged periods.

A further object of the invention is to make use of conventional types of camshafts and valve arrangements. In other words, it is within the purview of my invention to provide a mechanism that transmits the appropriate valve opening forces from the cam lobe to the valve at the most effective times.

Still another object of the invention is to provide a valve actuating mechanism that will reduce impact forces that might otherwise damage the cams or the valves. In this regard, it is planned that my mechanism can be readily adjusted for a predetermined amount of valve lash or play.

Another object is to provide a valve operating mechanism that is rugged, requiring little or no maintenance, yet enabling repairs to be inexpensively made should an engine having my invention installed thereon require reconditioning or refurbishing.

A specific object of my invention is to employ two rocker arms of identical construction which may be readily interchanged with each other. In this way tooling, fabricating, refurbishing and inventory costs can be minimized.

Also, the invention has for an object the facile lubrication of all moving parts comprising the valve adjusting mechanism.

Another object is to provide a variable valve operating mechanism that will be quite compact, thereby enabling it to be used in conjunction with vehicle engines where under-the-hood space is exceedingly important.

Still further, an object of my invention is to provide a variable valve operating mechanism that can be used in conjunction with conventional sensing devices. In this regard, my invention lends itself readily to being controlled by a conventional vacuum device, such as a diaphragm connected to the intake manifold of the internal combustion engine, and to a speed responsive device, such as a governor that is driven in accordance with the engine's speed.

In general, an overall object of my invention is to effect certain variations relating to the opening and closing of valves, either inlet or exhaust, that will achieve an optimum operating efficiency over a wide range of engine speeds and loads, both normal and abnormal.

Briefly, my invention envisages a pair of duplicate (or similar) rocker arms, the lower rocker arm being pivoted about a fixed axis and the upper rocker arm about a shiftable axis. When the shiftable axis is moved toward the fixed axis, then the combined moment arms of the two rocker arms is increased so that the amount of valve opening, that is, the valve lift, is first increased without affecting the duration that the valve is open. The rocker arms are each provided with straight or linear sections, the free end of the upper rocker arm moving along the straight section of the lower rocker arm and the cam lobe engaging the straight section of the upper arm as it is shifted or moved to progressively increase just the valve lift without affecting the valve duration. However, further shifting of the movable axis in the direction of the fixed axis will cause the lobe on the cam of the engine's camshaft to engage a curved or nonlinear section of the upper rocker arm during the rotation of the cam, thereby causing an increase of the duration or time that the valve is open.

Each rocker arm is equipped with an adjustable contact pad so that initially any valve lash can be minimized, yet adjustments easily made for any wear occurring over a prolonged period of time. Further, each rocker arm is channeled or grooved so as to retain an adequate quantity of lubricating oil for use when the engine is restarted. In other words, the invention provides a reservoir or dam configuration for the retention of a quantity of oil between the engine starts to provide lubrication until normal oil flow is established. Also, my invention provides a continued lubrication of its moving parts under various load conditions imposed on an engine equipped by my valve actuating mechanism.

DESCRIPTION OF THE PREFERRED EMBODIMENT

Figure 1:
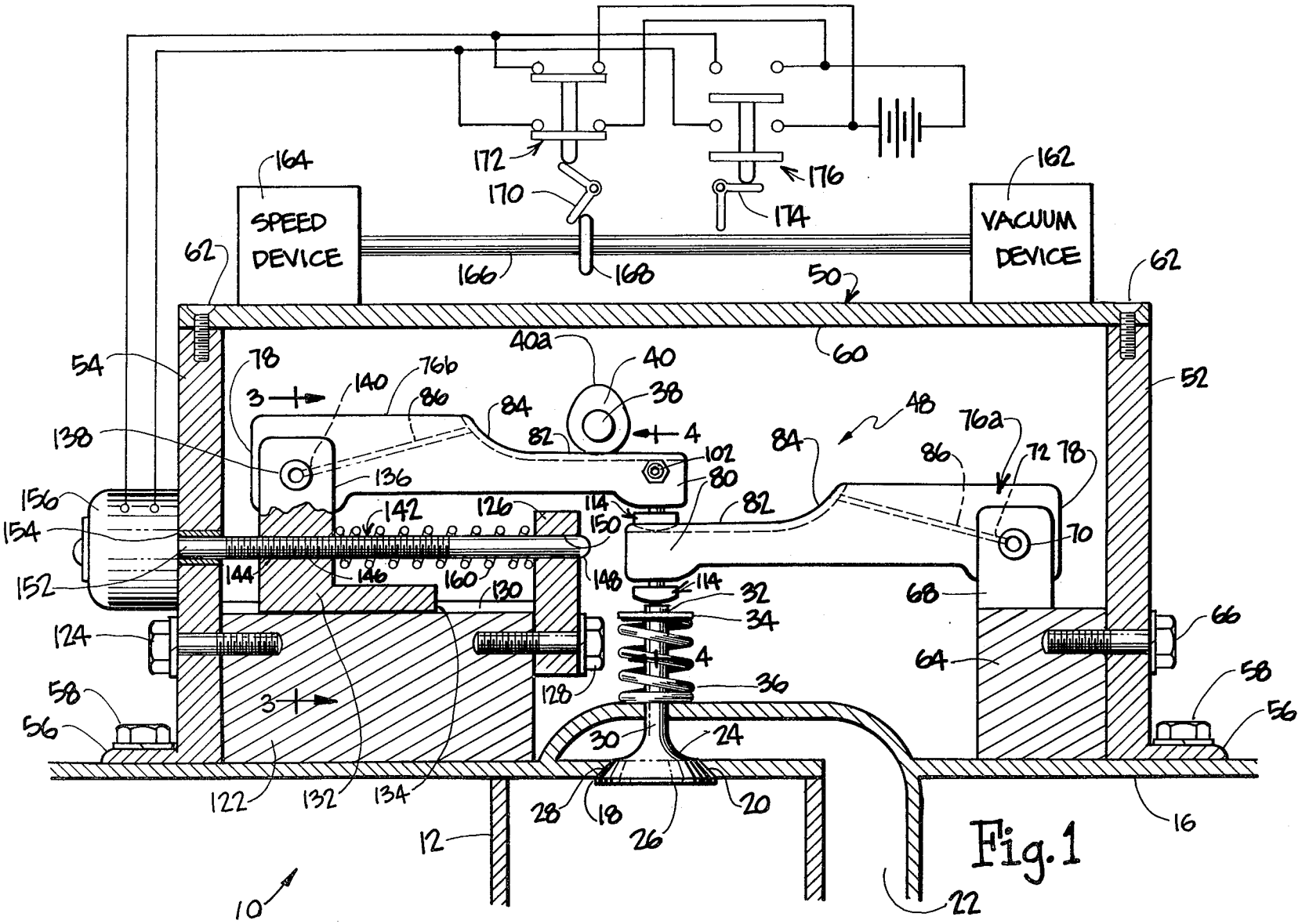
FIG. 1 is a diagrammatic view depicting my valve adjusting mechanism in an economy or cruise mode, the valve being closed.
Figure 2:
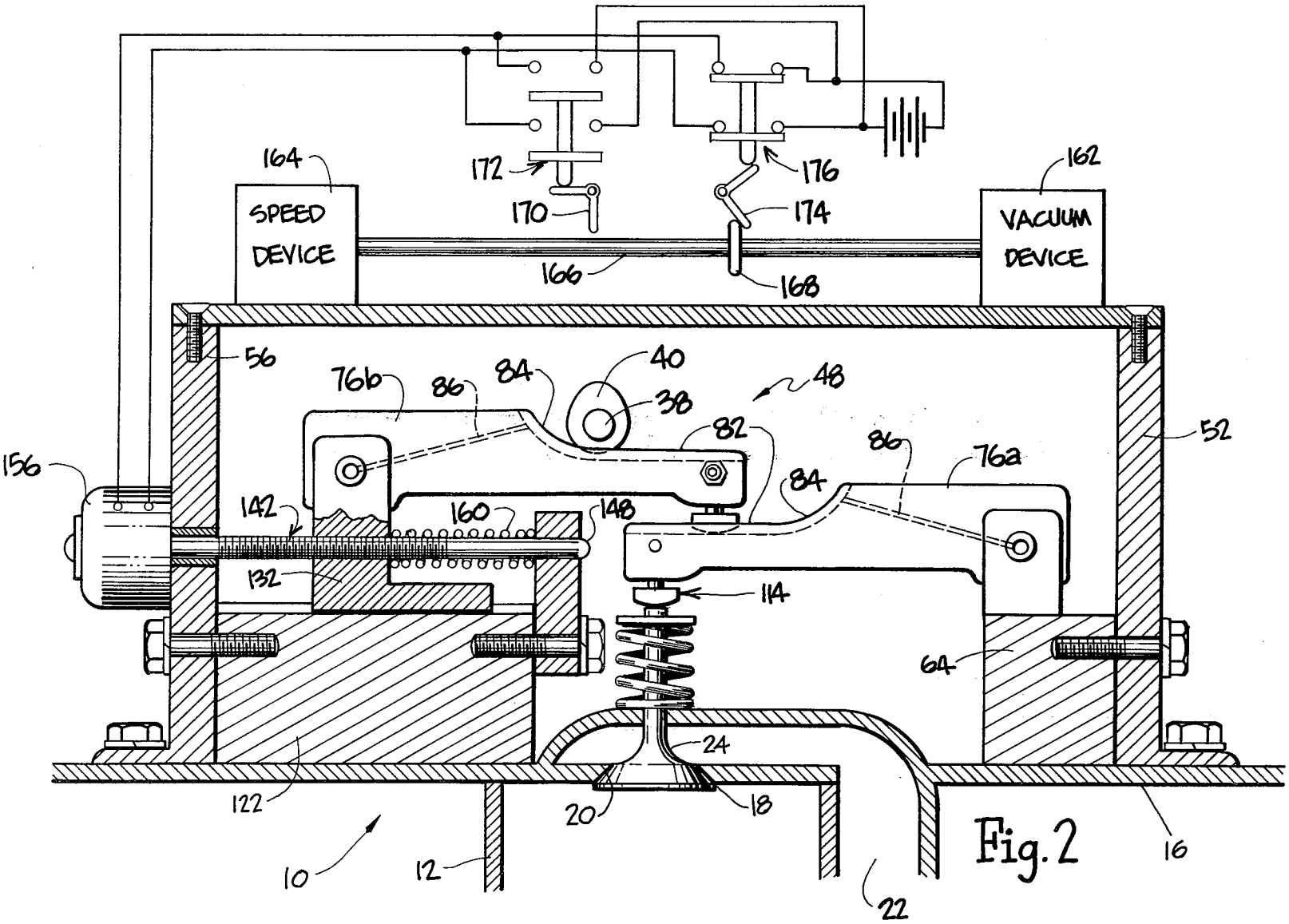
FIG. 2 is a diagrammatic view corresponding to FIG. 1 but with the mechanism adjusted for a high performance mode, the valve also being closed in this view.

Referring to the drawings, a conventional internal combustion engine 10 has been fragmentarily depicted in FIGS. 1 and 2. The engine 10 includes a cylinder block 12 containing a combustion chamber 14 therein, being one of any number of cylinders. Overlying the cylinder block 12 and secured thereto is a cylinder head 16. It will be discerned that there is a valve port 18 formed by a downwardly facing beveled seat 20. For the sake of simplicity, it will be considered that the valve port 18 constitutes an intake opening. Therefore, a passage 22 extends to the opening or port 18 from the intake manifold (not shown) of the engine 10.

Also conventionally included is a valve 24 having a valve head 26 at its lower end, the valve head 26 being beveled at 28 so as to seat against the beveled seat 20. Extending upwardly from the head 26 is a stem 30. Formed in the upper end portion of the stem 30 is an annular groove 32 for anchoring a washer-like retainer 34. A coil spring 36 acts against the retainer 34 to normally close the valve 24.

A camshaft 38, which is driven from the engine 10, has a conventional valve cam 40 mounted thereon, the cam having an appropriately contoured lobe **40*a*. Actually, it will be appreciated that the camshaft 38 has a number of cams thereon, whatever number is needed for the number of cylinders or combustion chambers 14 that the engine 10 has. As already indicated, it has been assumed that the valve port 18 constitutes an intake valve opening, the valve 24 hereinafter being referred to as an intake valve. Obviously, each combustion chamber or cylinder 14** would have an exhaust valve. As the description progresses, it will become manifest that my invention is suitable for the control of both inlet and exhaust valves.

At this time, it will be stated that my valve actuating mechanism has been indicated generally by the reference numeral 48. The mechanism 48 includes a valve cover denoted in its entirety by the reference numeral 50. The valve cover includes side walls 52 and 54, as well as end walls not necessary to identify. The side walls 52 and 54 are provided with hold-down feet 56 which are anchored to the cylinder head 16 by means of screws 58. A lid 60 is held in place by screws 62 which extend downwardly into the upper edges of the side walls 52, 54.

Secured to the inner face of the side wall 52 is a support block 64, the block 64 being held in place by means of anchor bolts 66. Extending upwardly from the block 64 is a pair of upstanding ears 68 (actually two for each valve to be actuated). A tubular shaft 70 extends through the upstanding ears 68, having a radially directed oil hole as indicated at 72. In practice, it is intended that one end of the tubular shaft 70 be connected to an oil supply denoted by the numeral 74 (see FIG. 3 depicting the shiftable axis for the rocker arm **76*b***) so that oil can be delivered therethrough for lubricating purposes presently to be explained.

Playing an important role in the practicing of the invention are two identical rocker arms **76*a* and 76*b* included in my mechanism 48. Inasmuch as the rocker arms are replicas of each other, identical reference numerals will be employed in the description of the parts constituting the arm in each instance. However, the two arms 76*a* and 76*b*** are mounted differently, so using the letter suffixes "a" and "b" will help in distinguishing the two rocker arms as to their respective functions.

Figure 4:
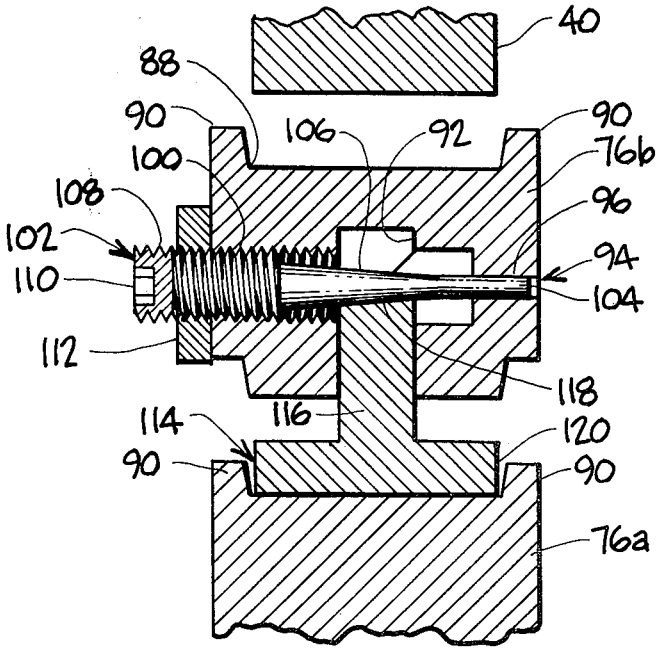
FIG. 4 is a greatly enlarged sectional view taken in the direction of line 4—4 of FIG. 1 for the purpose of showing the channeled construction of one of the two rocker arms and also the manner in which its contact pad can be adjusted to minimize valve lash.

With respect to the rocker arm **76*a*, it can be seen from FIGS. 1 and 2 that one end 78 thereof is pivotally mounted on the previously mentioned tubular shaft 70. The other end 80, which is a free end, acts against the upper end of the valve stem 30 in a manner hereinafter referred to. At this time, however, it is to be noted that the rocker arm 76*a* includes a straight section 82 and an upwardly curving cam or nonlinear profile section 84, the cam section 84 having an oil hole 86 formed therein which communicates with the oil hole 72 in the tubular shaft 70. Thus, when oil under pressure is forced through the tubular shaft 70, some of the oil is discharged through the oil holes 72 and 86 onto the upwardly curving cam section 84. From FIG. 4 it will be observed that the upper side of the rocker arm 76***a* is channeled or grooved as indicated by the reference numeral 88, the groove 88 being formed by dams or ridges 90 extending along each side of the rocker arm 76*a*.

Figure 3:
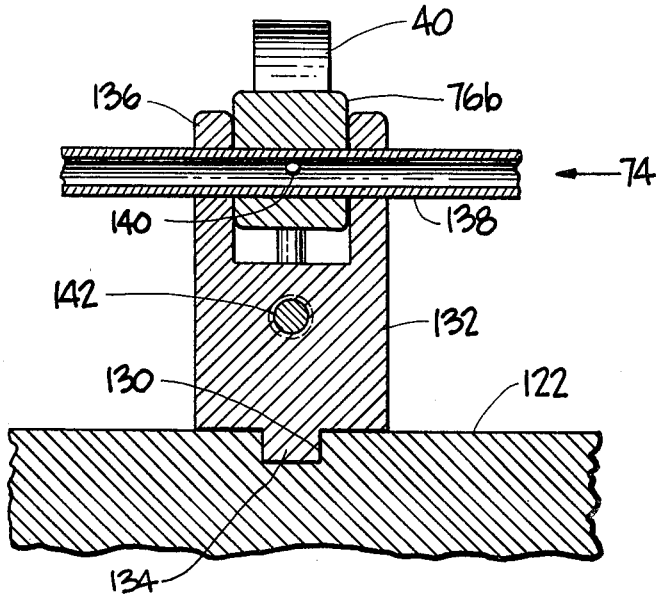
FIG. 3 is a sectional view taken in the direction of line 3—3 of FIG. 1 for the purpose of showing to better advantage how the rocker arms are mounted and the manner in which lubrication is achieved.

Also, from FIG. 3, it will be perceived that the free end 80 of the rocker arm 76*a* has a vertically drilled hole 92. At the upper end of the hole 92 is a transversely drilled hole 94 having a small diameter section 96, a counterbored section 98 and a large diameter tapped section 100. Contained within the transversely drilled hole 94 is a screw member 102 having a small diameter section 104 loosely received in the small diameter section 96 of the hole 94, an intermediate tapered section 106 and a larger diameter threaded section 108. In order that the screw member 102 can be rotated by means of a socket head wrench, a hexagonal recess 110 is formed in the large end of the screw member 102. Once rotatively adjusted, a lock nut 112, when tightened, maintains the screw member 102 in its adjusted position.

The purpose of the screw member 102 is to determine the position of a contact pad 114. The contact pad 114 includes a cylindrical shank 116 having an inclined or sloping upper end 118. At the lower end of the shank 116 is an arcuate shoe 120 that engages the upper end of the valve stem 28.

Corresponding generally to the platform 64 is a second support block 122, the block 122 being secured to the other side wall 54 of the cover unit 50 by means of anchor bolts 124. Although it does not have to be continuous, a strip 126 extends along the upper marginal edge portion of the inner vertical face of the block 122, being secured in place by means of bolts 128. The upper horizontal face of the block 122 has a transverse groove 130 formed therein that extends from the side wall 54 to the strip 126 for a purpose made clear immediately below.

In the exemplary situation, the upper face of the fixed block 122 slidably supports a block 132 having a rib 134 extending downwardly therefrom into the groove 130 so as to guide the slidable block transversely between the side wall 54 and the strip 126. The block 132 has a pair of upstanding ears 136 which correspond in function to the earlier-mentioned ears 68 on the block 64. It should be taken into account that the ears 68 and the ears 136 would not have to be separate and distinct; instead, slots could be milled in a solid strip if desired for accomplishing the pivoting of the rocker arm 76*a* in one instance and the rocker arm 76*b* in the other instance.

At any rate, a tubular shaft 138 extends through the ears 136, the tubular shaft 138 having an oil hole 140 which communicates with the oil hole 86 of the rocker arm 76*b*, there being one such oil hole 86 in each of the rocker arms 76*a*, 76*b* inasmuch as the rocker arms are duplicates of each other. Unlike the tubular shaft 70 which provides a fixedly located axis for the rocker arm 76*a*, the shaft 138 provides a movable or shiftable axis for the rocker arm 76*b*.

The manner in which the slidable block 132 is shifted will now be described. In this regard, a rotatable shaft 142 has a threaded section 144 that passes through a correspondingly threaded hole 146 formed in the lower part of the block 132. The shaft 142 also has a smooth or untapped end section 148 that is journaled in an untapped hole in the strip 126. The shaft 142 has a second unthreaded section 152 that is journaled in a sleeve bearing 154 press-fitted into a hole drilled in the side wall 54.

Mounted to the outer face of the side wall 54 is a relatively small reversible motor 156 suitably fastened to the side wall 54. Consequently, when the motor 156 is energized for operation in one rotative direction, the threaded section 144 will cause the block 132 to be advanced to the right from the position depicted in FIG. 1 to that pictured in FIG. 2. Although not entirely necessary, a coil spring 160 is employed so the block 132 is biased in a direction to maintain engagement between the threaded section 144 and the threaded hole 146.

Referring now to two sensors, and inasmuch as vacuum responsive devices, speed responsive devices and microprocessors utilized in conjunction with internal combustion engines are well known, no need exists for detailing the construction of such devices when employed in conjunction with my mechanism 48. Since the actuating mechanism 48 is intended to be automatically controlled in accordance with the vacuum prevailing at any given moment in the intake manifold (where my invention is used for controlling an inlet valve) a vacuum device 162 has been shown in block form, being connected to the intake manifold (not shown). It can be a simple diaphragm device. Also, a speed responsive device 164 operates in accordance with the speed of the engine 10, as does camshaft 38.

Extending between the vacuum device 162 and the speed responsive device 164 is a control rod 166 having a disk 168 attached thereto so that the disk 168 moves to the left and right in unison with the control rod 166. When the disk 168 moves sufficiently to the left, it engages a lever 170 associated with a switch 172 in circuit with the motor 156 which causes the shaft 142 to be rotated in a direction to shift the block 132 from the position in which it is shown in FIG. 1 to the position in which it appears in FIG. 2. Conversely, when the control rod 166 is moved to the right, a switch lever 174 is engaged which is associated with a switch 176 which energizes the motor 156 to cause rotation thereof in an opposite direction, thereby returning the block 132 from the position in which it appears in FIG. 2 to that in which it appears in FIG. 1. The foregoing operation, in a sense, can be likened to that of a power window which conventionally can be moved into various positions, any one of which is firmly and unyieldingly maintained until the motor is energized to change the window position.

Of course, it must be recognized that various intermediate positions of the block 132 can be established so that there is virtually an indeterminate number of adjusted positions that the rocker arm 76*b* can be moved into.

At this stage, it is to be appreciated that when the control rod 166 is moved a sufficient distance to the left, then the cam 40 rides against the curved cam section 84 to cause the rocker arm 76*b* to be forced downwardly for a longer period during each rotation of the camshaft 38, because engagement between the cam 40 and the cam section 84 is maintained for a longer period of time. Consequently, the valve 24 will be open for a longer period of time; not only that, but its lift or downward travel will be increased by reason of the increased moment arm existing under these circumstances by virtue of the end 80 of the rocker arm 76*b* being positioned nearer the fixed pivotal axis provided by the tubular shaft 70 than it is in FIG. 1.

Stated somewhat differently, when the motor 156 causes the block 132, and also the rocker arm **76*b* mounted thereon, to move to the right to the position of FIG. 2, the increased opening, both as to the lift of the valve member 24 and the duration or time in which it is maintained open, is increased. Hence, the charge of mixed fuel and air that is introduced via the passage 22 is increased and the engine 10 is conditioned for handling or coping with an increased load. This condition would be experienced in practice during, say, the acceleration of a vehicle having an engine equipped with my adjusting mechanism 48** thereon.

On the other hand, when the adjusting mechanism 48 is in the relationship appearing in FIG. 1, that is with the block 132 toward the left, the valve member 24 is not opened as long because the cam lobe **40*a* engages only the straight section 82. Hence, a lesser amount of mixed fuel and air enters the combustion chamber 14. This condition enhances the normal operation of the engine 10, such as when the vehicle is cruising. As already indicated, there are various intermediate positions that can be established for the rocker arm 76*b* with respect to the lobe 40*a* on the cam 40, all depending upon operating or load conditions experienced at any given moment by the engine 10**.

My invention can be used with a valve timing mechanism which angularly shifts the camshaft 38 in either rotative direction to advance or retard the opening of the valve 24 in relation to the crankshaft. A suitable timing mechanism is disclosed and claimed in my copending application for "Apparatus and Timing Mechanism for Controlling the Valve Operation of an Internal Combustion Engine", hereinbefore identified as a related application.

From the foregoing description, it should be apparent that my invention permits a valve operation to be established that will cause an additional quantity of fuel and air to be drawn into the compression chamber whenever it is needed. In a sense, under such a condition, the effect is analogous to that derived from supercharging or turbocharging. The advantage is that an economy mode of operation can be sustained for whatever periods such an operation is desirable, yet when an increased performance is required, an immediate adjustment can be produced so as to accommodate for sudden load changes. Consequently, if emissions are increased during such abnormal load happenings, they are of such short duration that the overall emission quantities are still quite negligible even though the operational characteristics are adjusted to suit the particular conditions that are experienced by the engine 10 at any given moment.

It should be further recognized that my invention permits adjustment of valve lash. The procedures used in adjusting my mechanism 48 to minimize the amount of valve lash are simple and straightforward. For instance, from FIG. 4 it can be seen that when the screw 102 thereappearing is rotated, as indicated above, the tapered section 106 thereof will be moved to the right with the consequence that the inclined top 118 of the shank 116 of the contact pad 114 will be forced farther downwardly. This forces the free end 80 of the rocker arm **76*a* upwardly. If the end 80 should be lowered, then the adjusting screw 102 is rotated in a reverse direction so as to move the tapered section 106** to the left.

Adjustment of the upper rocker arm **76*b* in each instance is virtually identical to any conventional non-hydraulic valve mechanism adjustment. More specifically, a gauge (not shown) of specified thickness is inserted endwise between the base circle of the cam 40 and the flat contact surface of the upper rocker arm 76*b*, that is, against the bottom of the groove 88 and between the ridges 90 forming the groove 88. With the gauge in place, the screw 102 for the upper rocker arm 76*b*** is rotated so that the proper clearance or spacing is obtained.

I claim:

1. A mechanism for varying the lift and duration of a valve member associated with an internal combustion engine in which the engine has a camshaft and a cam on said shaft, the mechanism comprising first and second rocker arms, means mounting one end of each of said rocker arms for pivotal movement about relatively movable axes, the other end of said first rocker arm being engageable with said valve member and the other end of said second rocker arm being engageable with said first rocker at various locations therealong in relation to the distance between said axes, said cam being engageable with said second rocker arm at various locations therealong also in relation to the distance between said axes, said first rocker arm having a straight section extending from said other end thereof toward said one end thereof, said other end of the second rocker arm being engageable with the straight section of said first rocker arm at various locations therealong depending on the distance between said axes, said second rocker arm having a straight section extending from said other end thereof to a curved arm section and said cam section extending from the straight section of said second rocker arm toward the said one end thereof, said cam being engageable with various locations along the straight and curved sections of said second rocker arm in relation to the distance between said axes and said straight sections being parallel when said valve member is in a closed position, and means constraining said rocker arms for relative movement along a path generally parallel to said straight sections.

2. A mechanism for operating a valve of an internal combustion engine having a camshaft, a cam on said shaft rotatable about a first axis and a valve member mounted for reciprocable movement along a second axis for opening and closing a valve port in communication with a combustion chamber of the engine, the mechanism comprising a first rocker arm, means mounting said first rocker arm for pivotal movement about a third axis fixedly spaced from said second axis a distance so that the same portion of said rocker arm always engages said valve member at a point substantially on said second axis, a second rocker arm. means mounting said second rocker arm for pivotal movement about a fourth axis movable toward and away from said third axis and relative to said first and second axes so that the same portion of said second rocker arm engages various longitudinal portions of said first rocker arm in direct relation to the variable spacing between said third and fourth axes, said cam engaging various longitudinal portions of said second rocker arm in the same direct relation to the variable spacing between said third and fourth axes, said second axis intersecting a line extending between said third and fourth axes, and said same portion of said first rocker arm being adjacent said line extending between said third and fourth axes.

3. A mechanism for operating a valve of an internal combustion engine having a camshaft, a cam on said shaft, and a reciprocable valve member for opening and closing a valve port in communication with a combustion chamber of the engine, the mechanism comprising a first rocker arm, means mounting one end of said first rocker arm for pivotal movement about a fixed axis so that the other end of said rocker arm is engageable with said valve member, said first rocker arm having a straight section extending from its said other end toward its said one end to provide at least some of said various longitudinal portions of said first rocker arm, a second rocker arm, means mounting one end of said second rocker arm for pivotal movement about a movable axis so that the other end of said second rocker arm is engageable with various longitudinal portions of said first rocker arm between its said other end and its said one end, said second rocker arm having a straight section extending from its said other end toward its said one end to provide at least some of said longitudinal portions of said second rocker arm and said second rocker arm also having a cam section extending from its said straight section toward its said one end, said cam being engageable with various longitudinal portions of said second rocker arm between its said other end and its said one end, said rocker arms being replicas of each other.

4. A mechanism for operating a valve of an internal combustion engine having a camshaft, a cam on said shaft, and a reciprocable valve member for opening and closing a valve port in communication with a combustion chamber of the engine, the mechanism comprising a first rocker arm, means mounting one end of said first rocker arm for pivotal movement about a fixed axis so that the other end of said rocker arm is engageable with said valve member, said first rocker arm having a straight section extending from its said other end toward its said one end to provide at least some of said various longitudinal portions of said first rocker arm, a second rocker arm, means mounting one end of said second rocker arm for pivotal movement about a movable axis so that the other end of said second rocker arm is engageable with various longitudinal portions of said first rocker arm between its said other end and its said one end, said second rocker arm having a straight section extending from its said other end toward its said one end to provide at least some of said longitudinal portions of said second rocker arm and said second rocker arm also having a cam section extending from its said straight section toward its said one end, said cam being engageable with various longitudinal portions of said second rocker arm between its said other end and its said one end, said means mounting said one end of said rocker arm for pivotal movement about a movable axis including a mounting block, and means for shifting said mounting block so as to cause said other end of said second rocker arm to be moved along said straight section of said first rocker arm and to concomitantly cause said cam to engage portions of the straight section of said second rocker arm between said other end of said second rocker arm and said one end thereof, said block being shifted sufficiently so as to cause said cam to bear against the cam section thereof, said straight sections being parallel when said valve member is in a closed position and in which said mounting block is constrained for movement along a path parallel to said straight section, said mounting block including a threaded hole, and a rotatable shaft having a threaded section received in said threaded hole so that said mounting block can be shifted to position said second rocker arm at various positions so that its other end is positioned at various locations along the straight section of said first rocker arm between its said other end and its said one end.

5. A mechanism for varying the lift and duration of a valve member associated with an internal combustion engine in which the engine has a camshaft and a cam on said shaft, the mechanism comprising first and second rocker arms, means mounting one end of said rocker arms for pivotal movement about relatively movable axes, the other end of said first rocker being engageable with said valve member and the other end of said second rocker arm being engageable with said first rocker at various locations therealong in relation to the distance between said axes, said cam being engageable with said second rocker arm at various locations therealong also in relation to the distance between said axes, said first rocker arm having a straight section extending from said other end thereof toward said one end thereof, said other end of the second rocker arm being engageable with the straight section of said first rocker arm at various locations therealong depending on the distance between said axes, and in which said second rocker arm has a straight section extending from said other end thereof to a curved cam section and said cam section extending from the straight section of said second rocker arm toward the said one end thereof, said cam being engageable with various locations along the straight and curved sections of said second rocker arm in relation to the distance between said axes, said cam engaging said curved section when the distance between said axes is reduced sufficiently, means for relatively moving said axes including a shiftable block, the said one end of said second rocker arm being pivotally mounted on said block and means responsive to an operating condition of said engine for shifting said block and said rocker arm mounted thereon in a direction to reduce the distance between said axes sufficiently to cause said cam to engage said curved section when said operating condition has reached a certain value.

6. A mechanism in accordance with claim 5 in which said responsive means is responsive to vacuum and engine speed.

7. A mechanism for varying the lift and duration of a valve member associated with an internal combustion engine in which the engine has a camshaft and a cam on said shaft, the mechanism comprising first and second rocker arms, means mounting one end of each of said rocker arms for pivotal movement about spaced axes, only the other end of said first rocker arm being engageable with said valve member and only the other end of said second rocker arm being engageable with said first rocker arm at various locations therealong in relation to the spacing between said axes, means for relatively moving said rocker arms toward and away from each other to vary the spacing between said axes, and said cam being engageable with said second rocker arm at various locations therealong also in relation to the spacing between said axes, the particular location being engaged by said cam depending on the spacing between said axes as determined by said moving means.

8. A mechanism in accordance with claim 7 in which said first rocker arm has a straight section extending from said other end thereof toward said one end thereof, said other end of the second rocker arm being engageable with the straight section of said first rocker arm at various locations therealong depending on the spacing between said axes as determined by said moving means, and in which said second rocker arm has a straight section extending from said other end thereof to a curved cam section and said cam section extending from the straight section of said second rocker arm toward the said one end thereof, said cam being engageable with various locations along the straight and curved sections of said second rocker arm in relation to the spacing between said axes as determined by said moving means.

9. A mechanism in accordance with claim 8 in which said cam engages said curved cam section when the spacing between said axes is reduced sufficiently.

10. A mechanism in accordance with claim 9 including means for relatively moving said axes.

11. A mechanism in accordance with claim 9 in which said means for relatively moving said axes includes a shiftable block, the said one end of said second rocker arm being pivotally mounted on said block.

12. A mechanism in accordance with claim 11 including means responsive to an operating condition of said engine for shifting said block and said second rocker arm mounted thereon.

13. A mechanism for operating a valve of an internal combustion engine having a camshaft, a cam on said shaft, and a reciprocable valve member for opening and closing a valve port in communication with a combustion chamber of the engine, the mechanism comprising a first rocker arm, means mounting a portion near one end of said first rocker arm for pivotal movement about a first axis so that a certain portion nearer the other end of said rocker arm is engageable with said valve member, a second rocker arm, means mounting a portion near one end of said second rocker arm for pivotal movement about a second axis, means relatively moving said rocker arms in a direction toward and away from each other to vary the spacing between said axes so that the other end of said second rocker arm is engageable with various longitudinal portions of said first rocker arm between its said other end and its said one end, said cam being engageable with various longitudinal portions of said second rocker arm between its said other end and its said one end, the particular longitudinal portion being engaged by said cam depending on the spacing between said axes as determined by said moving means.

14. A mechanism in accordance with claim 13 in which said straight and cam sections of said first and second rocker arms are grooved or recessed.

15. A mechanism in accordance with claim 14 including a contact pad mounted at said other end of said second rocker arm, the groove of said first rocker arm having a width sufficient to accommodate the one end of said contact pad therein.

16. A mechanism in accordance with claim 15 in which the groove of said second rocker arm has a width sufficient to accommodate the periphery of said cam therein.

17. A mechanism in accordance with claim 16 in which said other ends of said first and second rocker arms have holes therein, each contact pad having a shank received in the particular hole for the rocker arm with which it is associated, and respective means for determining the distance each shank is received in its said hole.

18. A mechanism in accordance with claim 17 including a transverse hole intersecting said shank-receiving passage, a section of said transverse hole in each instance being threaded, and an adjusting member threadedly received in said threaded portion of said transverse passage, said adjusting member having a tapered section thereon for determining the distance said shank is received in said shank-receiving hole.

19. A mechanism in accordance with claim 13 in which said first rocker arm has a straight section extending from its said other end toward its said one end to provide at least some of said various longitudinal portions of said first rocker arm.

20. A mechanism in accordance with claim 19 in which said second rocker arm has a straight section extending from its said other end toward its said one end to provide at least some of said longitudinal portions of said second rocker arm.

21. A mechanism in accordance with claim 20 in which said second rocker arm has a cam section extending from its said straight section toward its said one end.

22. A mechanism in accordance with claim 21 in which said first rocker arm has a cam section extending from its said straight section toward its said one end.

23. A mechanism in accordance with claim 22 in which said means mounting said portion near one end of said second rocker arm for pivotal movement about a movable axis includes a mounting block, and means for shifting said mounting block so as to cause said portion near the other end of said second rocker to be moved along said straight section of said first rocker arm and to concomitantly cause said cam to engage portions of the straight section of said second rocker arm between said other end of said second rocker arm and said one end thereof.

24. A mechanism in accordance with claim 23 in which said block can be shifted sufficiently so as to cause said cam to bear against the cam section thereof.

25. A mechanism in accordance with claim 24 in which said straight sections are parallel when said valve member is in a closed position and in which said mounting block is constrained for movement along a path parallel to said straight sections.

* * * * *